US008456455B2

(12) United States Patent
Kojima et al.

(10) Patent No.: US 8,456,455 B2
(45) Date of Patent: Jun. 4, 2013

(54) DISPLAY DRIVING DEVICE AND DISPLAY APPARATUS

(75) Inventors: Hiroshi Kojima, Shiga (JP); Munehiko Ogawa, Kyoto (JP); Yasuhiro Hirokane, Osaka (JP); Kazuyoshi Nishi, Kyoto (JP)

(73) Assignee: Panasonic Corporation, Osaka (JP)

( * ) Notice: Subject to any disclaimer, the term of this patent is extended or adjusted under 35 U.S.C. 154(b) by 567 days.

(21) Appl. No.: 12/713,689

(22) Filed: Feb. 26, 2010

(65) Prior Publication Data

US 2010/0220080 A1 Sep. 2, 2010

(30) Foreign Application Priority Data

Mar. 2, 2009 (JP) ..... 2009-048655

(51) Int. Cl.
*G09G 5/00* (2006.01)

(52) U.S. Cl.
USPC ..... 345/204; 345/214; 345/77

(58) Field of Classification Search
USPC ..... 345/204, 205, 206, 211–215, 55, 345/76–83; 250/552, 553; 313/463, 498, 313/500, 506, 512; 315/169.3
See application file for complete search history.

(56) References Cited

U.S. PATENT DOCUMENTS 6,549,186 B1 4/2003 Kwon
6,573,881 B1 6/2003 Kwon
6,650,308 B2 11/2003 Kawashima
7,230,597 B2 * 6/2007 Edwards et al. ..... 345/87
7,304,632 B2 * 12/2007 Kodama et al. ..... 345/100
7,772,766 B2 * 8/2010 Aoki ..... 313/506
8,009,130 B2 * 8/2011 Kim et al. ..... 345/87
8,089,437 B2 * 1/2012 Maekawa ..... 345/87
2002/0105492 A1 8/2002 Kosaka
2002/0186230 A1 12/2002 Kudo et al.
2003/0030602 A1 2/2003 Kasai (Continued)

FOREIGN PATENT DOCUMENTS

JP 2001-22329 1/2001
JP 2002-229525 8/2002

(Continued)

OTHER PUBLICATIONS

Japanese Office Action that issued with respect to Japanese Patent Application No. 2009-048655, mailed Nov. 24, 2010.
U.S. Appl. No. 12/713,491 to Nakamura et al., which was filed Feb. 26, 2010.

*Primary Examiner* — Tom Sheng
(74) *Attorney, Agent, or Firm* — McDermott Will & Emery LLP

(57) ABSTRACT

A display driving device is provided which drives a display panel having source lines provided for columns of pixels and which includes: first switches sw1 provided for the source lines; second switches sw2 provided for the source lines; AMP units 52 which are provided for the source lines and drive a pixel signal to the source lines via the second switches; an external power source 48 applying an intermediate voltage of the pixel signal to an intermediate voltage line, the intermediate voltage having a level between a minimum voltage level and a maximum voltage level of the pixel signal; and a control circuit 47 controlling turning on and off the first switches and the second switches, wherein the control unit temporarily turns off at least part of the second switches, and concurrently, temporarily turns on corresponding ones of the first switches during a transition period of the pixel signal.

11 Claims, 15 Drawing Sheets

U.S. PATENT DOCUMENTS

| | | | | |
|---|---|---|---|---|
| 2004/0239655 | A1 | 12/2004 | Tani et al. | |
| 2006/0125733 | A1 | 6/2006 | Dagois | |
| 2008/0238850 | A1 | 10/2008 | Watanabe | |
| 2009/0160882 | A1* | 6/2009 | Kiya et al. | 345/690 |
| 2009/0225066 | A1* | 9/2009 | Sawahata | 345/211 |
| 2009/0289933 | A1 | 11/2009 | Moriyama et al. | |

FOREIGN PATENT DOCUMENTS

| | | |
|---|---|---|
| JP | 2002-366112 | 12/2002 |
| JP | 2003-114645 | 4/2003 |
| JP | 2008-241832 | 10/2008 |
| WO | 03/060867 | 7/2003 |

* cited by examiner

DISPLAY DRIVING DEVICE AND DISPLAY APPARATUS

BACKGROUND OF THE INVENTION (1) Field of the Invention

The present invention relates to a display apparatus and a display driving device for use in a television receiver, a personal computer, a workstation, or the like.

(2) Description of the Related Art

Conventionally, in some liquid crystal panels, a positive video signal and a negative video signal are alternately driven, which is called "inversion driving". In this inversion driving, there is a technique for reducing power consumption by creating electrical conduction between adjacent terminals in an IC in operation to reuse charges (see Patent Reference 1: Japanese Unexamined Patent Application Publication 2001-022329, for example).

FIG. 11 is a structural diagram illustrating a conventional display apparatus with a power-saving circuit using the inversion driving scheme, shown in the above Patent Reference 1.

Referring to FIG. 11, a liquid crystal panel 141 is configured to be driven by a source driver 142 having a source driving unit 143 and a line switching unit 144, and an external capacitor 145 is connected to the liquid crystal panel 141. To explain the inversion driving scheme which the liquid crystal panel 141 is characterized in, FIG. 12 shows a positive video signal and a negative video signal in the conventional inversion driving scheme. The positive and negative video signals in this figure are alternately supplied from the source driver 142 to the liquid crystal panel 141.

SUMMARY OF THE INVENTION

For conventional display apparatuses in which positive video signal and negative video signal are alternately driven (that is, in which so-called inversion driving is performed) as described in the Patent Reference 1, the above scheme is effective because these signals are across the intermediate signal level between signal levels of the positive and the negative video signals. However, the reuse of charges by merely shorting a circuit between adjacent terminals and using the external capacitor is not applicable to, for example, an organic electroluminescent (EL) panel, which does not use the method of driving positive and negative video signals alternately (that is, which is not capable of inversion driving), and there remains a problem that electrical power saving is difficult.

In addition, recent increases in output and in driving load and speed cause a problem of heat which is generated by ICs.

The present invention has been made for solving the above existing problems, and therefore an object of the present invention is to provide a display driving device and a display apparatus, which reuse charges to save electrical power and reduce heat generation.

To solve aforementioned problems, a display driving device according to an aspect of the present invention is a display driving device that drives a display panel having source lines each provided for a corresponding one of columns of pixels, the display driving device including: first switches each provided for a corresponding one of the source lines; second switches each provided for a corresponding one of the source lines; drivers each of which is provided for a corresponding one of the source lines and drives a pixel signal to the corresponding one of the source lines via a corresponding one of the second switches; a power source unit configured to apply an intermediate voltage of the pixel signal to an intermediate voltage line, the intermediate voltage having a level between a minimum voltage level and a maximum voltage level of the pixel signal; and a control unit configured to control turning on and off the first switches and the second switches, wherein each of the first switches has a first end connected to the intermediate voltage line and a second end connected to a corresponding one of the source lines, each of the second switches has a first end connected to a corresponding one of the drivers and a second end connected to a corresponding one of the source lines and to a second end of a corresponding one of the first switches, and the control unit is configured to temporarily turn off at least part of the second switches, and concurrently, temporarily turn on corresponding ones of the first switches during a transition period from an output period of a pixel signal to an output period of a subsequent pixel signal.

This configuration enables a display panel which does not perform inversion driving, such as an organic electroluminescent (EL) panel, to reduce heat generation by reusing charges and moreover by causing a power source unit to absorb variations of charges which are not reusable, resulting in heat reduction and power saving of a display driving device and a display panel.

In more detail, the first switch is used to electrically short all or part of the source lines to one another and to connect the shorted source lines to the power source during the above transition period. The second switch is used to disconnect the shorted source lines from the driver during the transition period. For example, suppose that the total number of source lines is approximately 6,000. Among the 6,000 source lines, let's say 4,000 source lines have higher voltages than the intermediate voltage while 2,000 source lines have lower voltages than the intermediate voltage, just before the above shorting. The above shorting will then cause the 2,000 source lines having lower voltages than the intermediate voltage and 2,000 source lines out of the 4,000 source lines having higher voltages than the intermediate voltage to cancel out their opposite variations of charges (that is, reuse charges). This allows for less heat generation. In the conventional technique in which opposite variations of charges are unable to be cancelled out, all variations of charges are absorbed by a driver (meaning that an electric current will flow though the driver), which generates heat.

Furthermore, variations of charges in 2,000 source lines out of the 4,000 source lines having higher voltages than the intermediate voltage are absorbed by the power source unit via the first switch. This means that part of the heat generated in the driver can be generated instead by the power source unit.

As above, during the transition period, all or part of the source lines are electrically shorted to one another and connected to the power source unit. This leads to cancellation between the charges in the source lines which have higher voltages than the intermediate voltage immediately before shorting, and the charges in the source lines which have lower voltages than the intermediate voltage immediately before shorting. If the all or part of source lines are not electrically shorted to one another, the driver absorbs charges which are caused to move by changes in voltage of a pixel signal. The above shorting therefore allows for reduction in heat generation of the driver. In addition, the variations of charges unable to be cancelled out are absorbed by not the driver, but the power source, so that the heat which would be generated in the driver will be generated instead by the power source unit.

The configuration may be such that the driver, the first switches, the second switches, and the control unit are formed on the first semiconductor substrate and that the power source unit is formed on the second semiconductor substrate.

With this configuration in which the power source unit and the driver are formed on the different semiconductor substrates, it is possible to reduce the heat generated by the driver more efficiently.

The control unit may be configured to temporarily turn off all the second switches, and concurrently, temporarily turn on all the first switches during the transition period.

This configuration is able to simplify a circuit structure of the control unit, leading to reduction in circuit size.

The configuration may be such that the control unit has control circuits each provided for a corresponding one of the source lines, each of the control circuits temporarily turns on and off corresponding ones of the first switches and the second switches during the transition period in the case where a pixel signal and a subsequent pixel signal in a corresponding one of the source lines are across the intermediate voltage, and each of the control circuits maintains current states of corresponding ones of the first switches and the second switches during the transition period in the case where the a pixel signal and the subsequent pixel signal in the corresponding one of the source lines are not across the intermediate voltage.

In this configuration, when a pixel signal and the subsequent pixel signal in a source line are not across the intermediate voltage, the source line is not connected to the power source unit, which allows for a further decrease in heat generation and further reduction in power consumption.

The configuration may be such that the intermediate voltage line includes a first voltage line connected to one of the source lines for a first color via a corresponding one of the first switches, and a second voltage line connected to one of the source lines for a second color via a corresponding one of the second switches, and the power source unit is configured to output, as the intermediate voltage, a first voltage having a level intermediate between a minimum voltage level and a maximum voltage level of a pixel signal representing the first color, and is configured to output, as the intermediate voltage, a second voltage having a level intermediate between a minimum voltage level and a maximum voltage level of a pixel signal representing the second color.

In this configuration, when the pixel signal for one color has a different voltage range from the pixel signal for another color, it is possible to enhance the efficiency of reusing charges and to further reduce power consumption.

The display driving device may further include a third switch inserted between the intermediate voltage line and the first switches, and the control unit is configured to temporarily turn on the third switch after turning on the corresponding ones of the first switches.

In this configuration, immediately after the first switches shorten the source lines, the third switches connects the source lines to the power source unit, which makes it possible to suppress noise and shoot-through current as compared to a case where the shortening and the connecting are performed at the same time.

The display apparatus according to an aspect of the present invention includes the above display driving device and a display panel which is driven by the display driving device.

The display panel may be an organic electroluminescent panel.

The display apparatus according to an aspect of the present invention enables even a display apparatus which does not perform inversion driving, such as an organic EL panel, to reuse charges and reduce heat generation with a power source outside the apparatus, thus leading to power saving.

FURTHER INFORMATION ABOUT TECHNICAL BACKGROUND TO THIS APPLICATION

The disclosure of Japanese Patent Application No. 2009-048655 filed on Mar. 2, 2009 including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

First Embodiment

Figure 1:
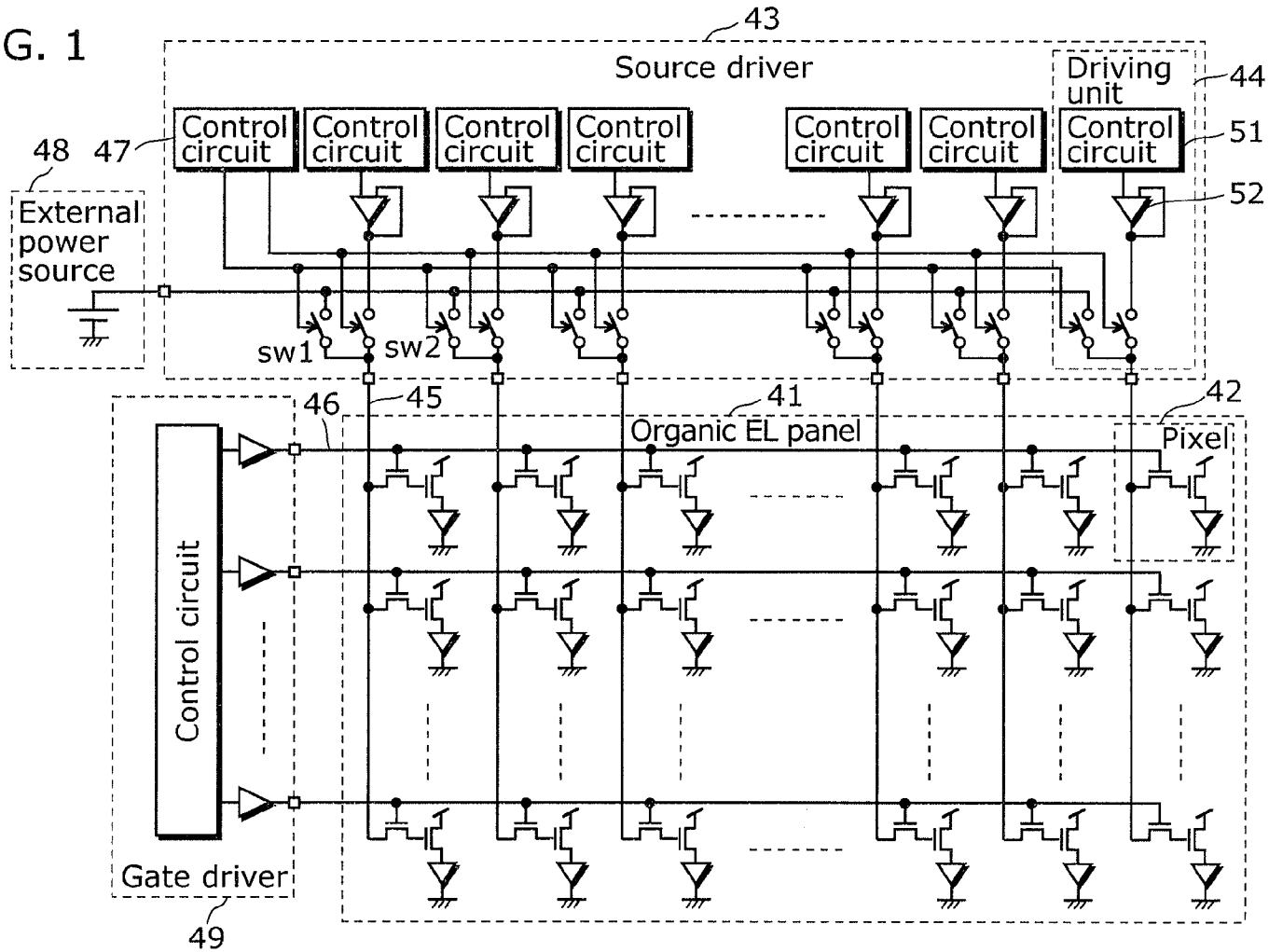
FIG. 1 is an overall structural diagram of a display apparatus according to the first embodiment.
Figure 2:
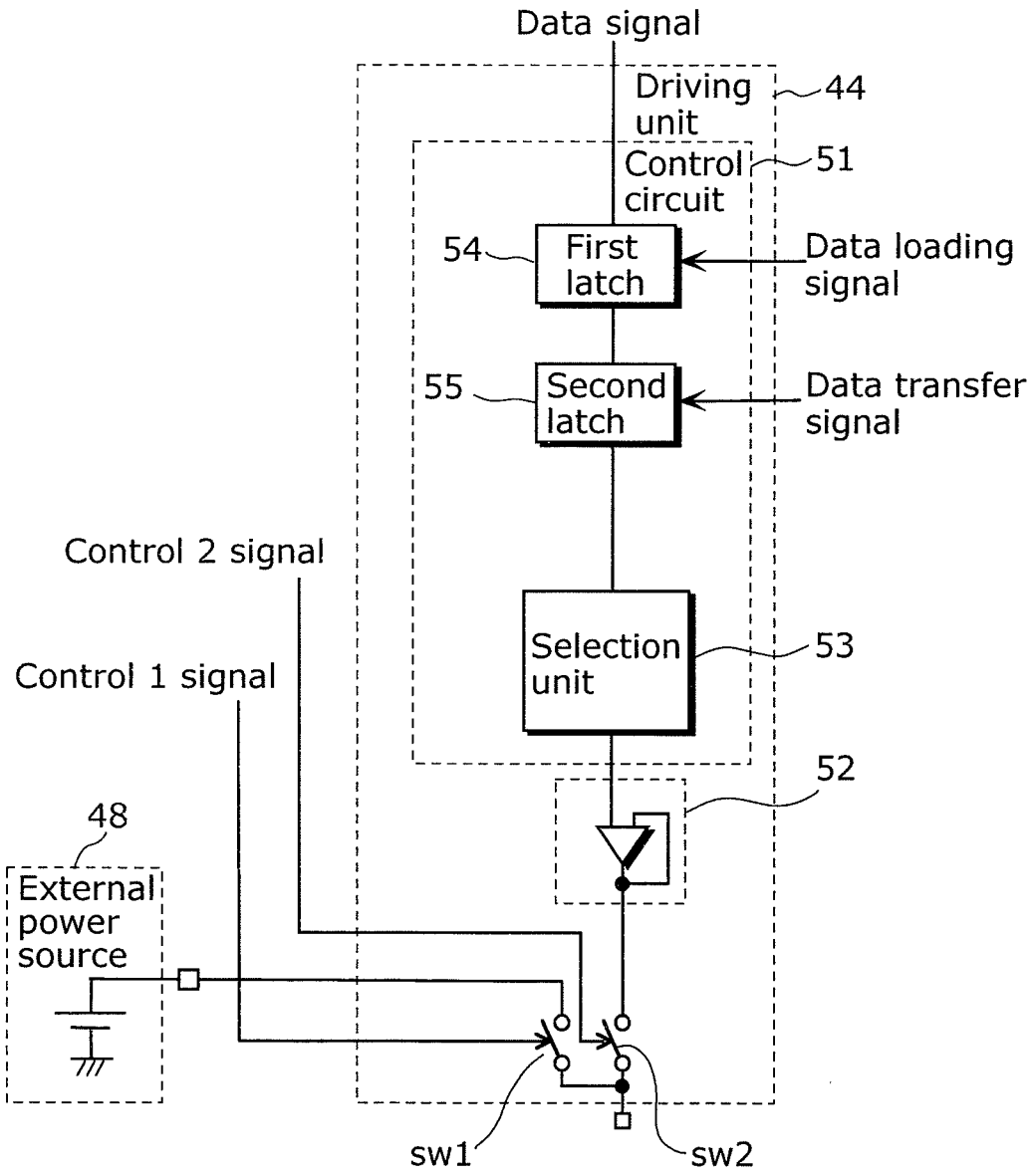
FIG. 2 is a view illustrating an example of detailed structure of a driving unit in a display driving device according to the first embodiment.

FIGS. 1 and 2 illustrate an example of structures of a display apparatus and a display driving device according to the first embodiment of the present invention.

FIG. 1 is an overall structural diagram of the display apparatus according to the present embodiment. This display apparatus includes an organic EL panel 41 as a display panel, a source driver 43, an external power source 48, and a gate driver 49.

The organic EL panel 41 has a plurality of pixels 42 arranged in rows and columns, source lines 45 each provided for a corresponding one of the columns of the pixels, and gate lines 46 each provided for a corresponding one of the rows of the pixels.

Together with the external power source 48, the source driver 43 functions as a display driving device for driving the display panel in which the source lines are provided respectively on the columns of the pixels.

This display driving device includes: first switches sw1 each provided for a corresponding one of the source lines 45; second switches sw2 each provided for a corresponding one of the source lines 45; AMP units 52 functioning as drivers for driving a pixel signal to the source lines 45 via the second switches sw2; the external power source 48 for applying to an intermediate voltage line the intermediate voltage which is between the maximum and the minimum voltages of the pixel signal; and a control circuit 47 for controlling turning on and off the first switches sw1 and the second switches sw2.

The source driver 43 has a control circuit 47 and driving units 44 each provided for a corresponding one of the source lines.

Each of the first switch sw1 has one end connected to the intermediate voltage line and the other end connected to a corresponding one of the source lines.

Each of the second switch sw2 has one end connected to a corresponding one of the AMP units 52 and the other end connected to a corresponding one of the source lines 45 and to the other end of a corresponding one of the first switches sw1.

The control circuit 47 temporarily turns off the second switches, and concurrently, temporarily turns on the corresponding first switches to these second switches during a transition period from an output period of a pixel signal to an output period of a subsequent pixel signal.

As the first switches sw1 and the second switches sw2 are controlled by the control circuit 47, all or part of the source lines are electrically shorted to one another and such sources lines are connected to the power source during the transition period. This leads to cancellation between the charges in the source lines which have higher voltages than the intermediate voltage immediately before shorting, and the charges in the source lines which have lower voltages than the intermediate voltage immediately before shorting. If the all or part of source lines are not electrically shorted to one another, the driver absorbs charges which are caused to move by changes in voltage of a pixel signal. The above shorting therefore allows for reduction in heat generation of the driver. In addition, the variations of charges unable to be cancelled out are absorbed by not the driver, but the power source, so that the heat which would be generated in the driver will be generated instead by the power source unit.

Each of the driving units 44, which is provided for a corresponding one of the source lines, includes a control circuit 51, the AMP unit 52 as a driver, the first switch sw1, and the second switch sw2, as shown by dashed lines in FIG. 1.

Next, FIG. 2 is a view illustrating an example of detailed structure of each of the driving units 44 in the display driving device according to the present embodiment. To be specific, FIG. 2 shows connection among the driving unit 44 for driving a corresponding one of the source lines 45, the external power source 48, and control 1 and 2 signals transmitted from the control circuit 47. As shown in this figure, the driving unit 44 includes the control circuit 51, the AMP unit 52, the first switch sw1, and the second switch sw2. The control circuit 51 includes a first latch 54, a second latch 55, and a selection unit 53.

Receiving a data loading signal, the first latch 54 stores image data of a digital signal transmitted thereto. Receiving a data transfer signal, the second latch 55 stores output from the first latch 54. Output of the second latch 55 is inputted to the selection unit 53 which is a digital-analog converter for converting a digital signal into an analog signal. The analog signal converted by the selection unit 53 is inputted to the AMP unit 52. The AMP unit 52 functions as a driver for driving the analog signal to the corresponding one of the source lines 45 via the second switch sw2.

Further, an output of the AMP unit 52 is connected to the corresponding one of the source lines 45 via the second switch sw2. The second switch sw2 is controlled by the control 2 signal. The external power source 48 is connected to a source line-side end of the second switch sw2 and is connected to the source line 45 via the first switch sw1 which is controlled by the control 1 signal.

Figure 3:
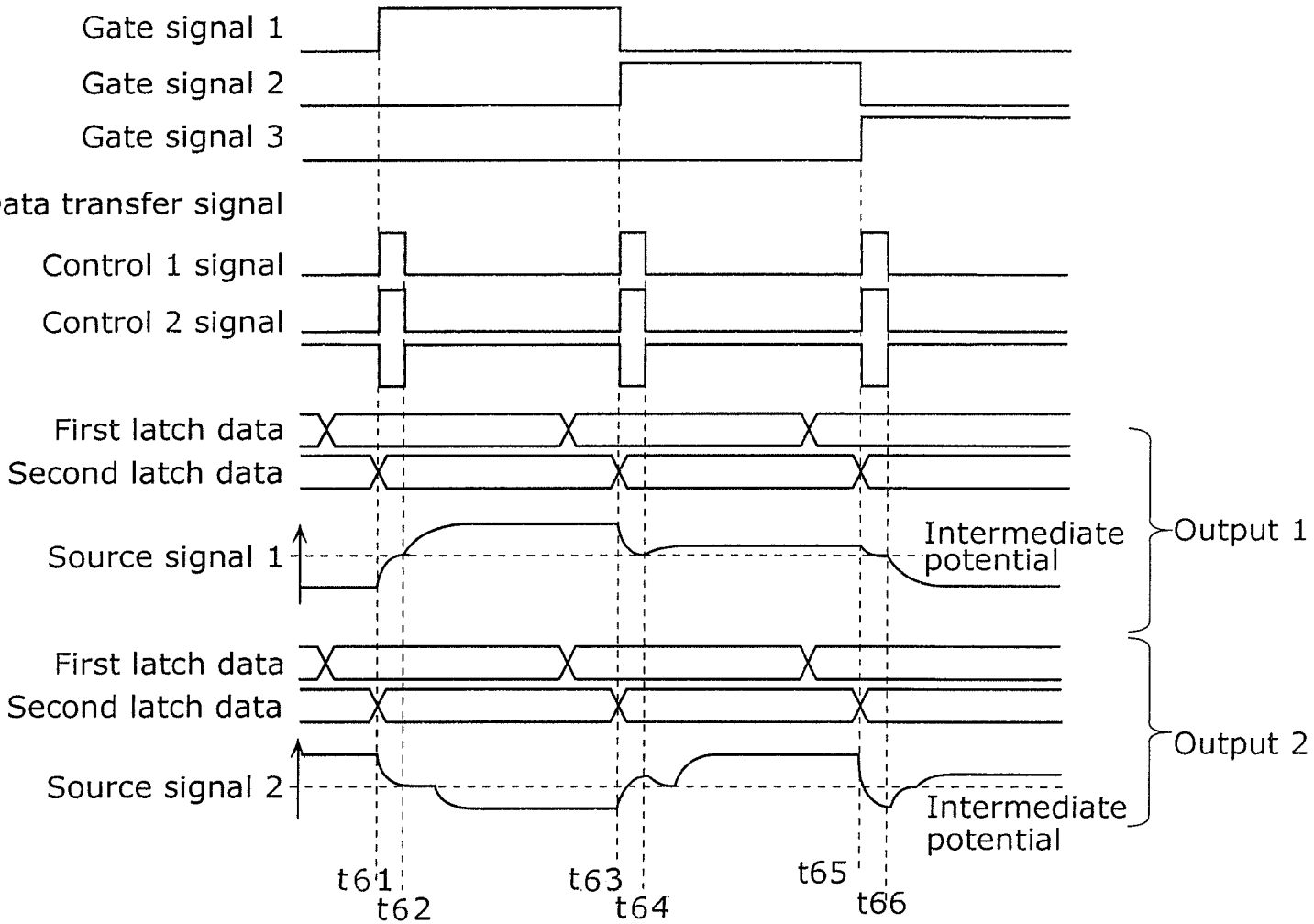
FIG. 3 is a timing chart for operations of the display apparatus according to the first embodiment.

The following shall describe operations of the display apparatus and the display driving device in the first embodiment, with reference to FIG. 3. FIG. 3 is a timing chart for operations of the display apparatus according to the first embodiment.

In FIG. 3, signal level status of three lines out of the multiple gate lines 46 in the organic EL panel 41 are shown as a gate signal 1, a gate signal 2, and a gate signal 3. Further, signal level status of two lines out of the multiple source lines 45 in the organic EL panel 41 are shown as a source signal 1 and a source signal 2. Furthermore, a dashed line indicates intermediate potential of output range of each of the source signals.

It should be noted that the data transfer signal, the control 1 signal, and the control 2 signals in FIG. 3 are those signals described in FIG. 2. The output of the first latch 54 is named as first latch data, and the output of the second latch 55 is named as second latch data.

Moreover, in FIG. 3, a rise of the gate signal 1 is called t61, a rise of the gate signal 2 is called t63, a rise of the gate signal 3 is called t65, and falls of the data transfer signal are called t62, t64, t66.

Referring to FIG. 3, first of all, the first latch 54 retrieves the pixel data of a digital signal when triggered by the data loading signal.

This operation is repeated in sequence for all the driving units 44 in an IC constituting the source driver 43. After the first latches 54 in all the driving units 44 retrieve desired pixel data, the data is transferred to the second latches 55 in synchronization with the rise t61 of the data transfer signal, and at the same time, the gate signal 1 rises, which brings the state where multiple pixels connected to the gate signal 1 can be driven from the source line 45.

Next, the image data transferred to the second latch 55 is inputted to the selection unit 53. The selection unit 53 converts the image data of a digital signal into analog voltage and transfers the analog voltage to the AMP unit 52. The AMP unit 52 drives the voltage and outputs it in form of a pixel signal to the source line 45. With the control 1 signal "high", the first switch sw1 is turned on and with the control 1 signal "low", the first switch sw1 is turned off.

With the control 2 signal "high", the second switch sw2 is turned on and with the control 2 signal "low", the second switch sw2 is turned off.

In synchronization with the data transfer signal 58, the control 1 signal becomes "high" and the control 2 signal becomes "low", with the result that the first switch sw1 is turned on and the second switch sw2 is turned off. In this state, the source line 45 is connected to the intermediate voltage line of the external power source 48. During the period from t61 to t62, the intermediate voltage supplied by the external power source 48 is thus applied to each of the source lines 45.

Afterwards, the control 1 signal becomes "low" and the control 2 signal becomes "high", with the result that the first switch sw1 is turned off and the second switch sw2 is turned on. This causes each of the source lines 45 to be connected to the AMP unit 52 so that voltage corresponding to the image data is applied to a corresponding one of the source lines 45.

By sequentially changing levels of the gate signal 2, the gate signal 3, and so on, the above operation is repeated for all the gate lines 46 of the organic EL panel 41. The voltage corresponding to the image data is applied to the pixel 42 which receives the "high" gate signal. Such voltage application is repeated in sequence for all the lines to display one frame.

In the display apparatus and the display driving device according to the first embodiment of the present invention explained above with reference to the drawings, suppose that 11 V is applied to half of the source lines in the panel and 1 V is applied to the other half of the source lines in the panel, and with the control 1 signal "high" and the control 2 signal "low", the intermediate voltage between 11 V and 1 V, that is, 6 V, is once applied to all the source lines 45 by the external power source 48, then voltages of all the source lines converge to 6 V.

In this case, the number of 11 V source lines is no more and no less than the number of 1 V source lines, and charges therefore move from the 11 V source lines to the 1 V source lines according to the principle of charge conservation, which makes it possible to supply charges up to 6 V without charge supplies from the external power source and from the source driver 43.

That is, even in the organic EL panel 41 in which a positive video signal and a negative video signal are not alternately driven (no inversion driving is performed), the display apparatus according to the first embodiment of the present invention allows for one-time application of the intermediate potential from the external power source 48 without exception, and enables a reduction by half in the amount of electricity charged to and discharged from the organic EL panel, so that electrical power saving can be achieved.

The organic EL panel in operation for displaying videos scarcely has the exact same number of 11 V source lines and 1 V source lines.

This is because a full high definition (FHD) panel has 1920×3=5760 source lines consisting, for example, 3840 source lines having 11 V and 1920 source lines having 1 V, and with the control 1 signal "high" and the control 2 signal "low", voltages of these source lines converge to (11V−1V)×⅔+1V=approximately 7.7 V which is then forced to reach 6 V by the external power source 48.

In the present invention, however, the external power source 48 is formed outside or on a semiconductor substrate different from the one on which the source driver 43 is formed.

Accordingly, the electricity for the difference in potential, that is, approximately 7.7 V−6 V=approximately 1.7 V is generated by the external power source 48 which produces heat according to the generated electricity.

In other words, such electricity of approximately 1.7 V which conventionally used to be driven by the source driver 43, is generated instead by the external power source 48, whereby the amount of heat produced by the source driver 43 can be reduced, in the display apparatus and the display driving device according to the first embodiment of the present invention.

The source driver 43 which produces less heat can have a larger pixel signal output per chip.

It is thus possible to save the cost of the organic EL panel by reducing the chips.

Second Embodiment

The first embodiment provides an example where all the source lines 45 are electrically shorted to one another and thus connected to the external power source 48 during the transition period. In the following second embodiment, an explanation is given to a structure of a display control unit which electrically shorts part of the source lines 45 to one another and connects the shorted source lines 45 to the power source 48 during the transition period.

Specifically, the display control unit according to the second embodiment includes control circuits each of which is provided for a corresponding one of the source lines and configured such that, when a pixel signal and the subsequent pixel signal in a corresponding one of the source lines are across the intermediate voltage of the external power source 48, corresponding ones of the first and the second switches are temporarily turned on and off during the above transition period, and when a pixel signal and the subsequent pixel signal in the corresponding one of the source lines are not across the above intermediate voltage, the corresponding ones of the first and the second switches remain still during the above transition period.

Figure 4:
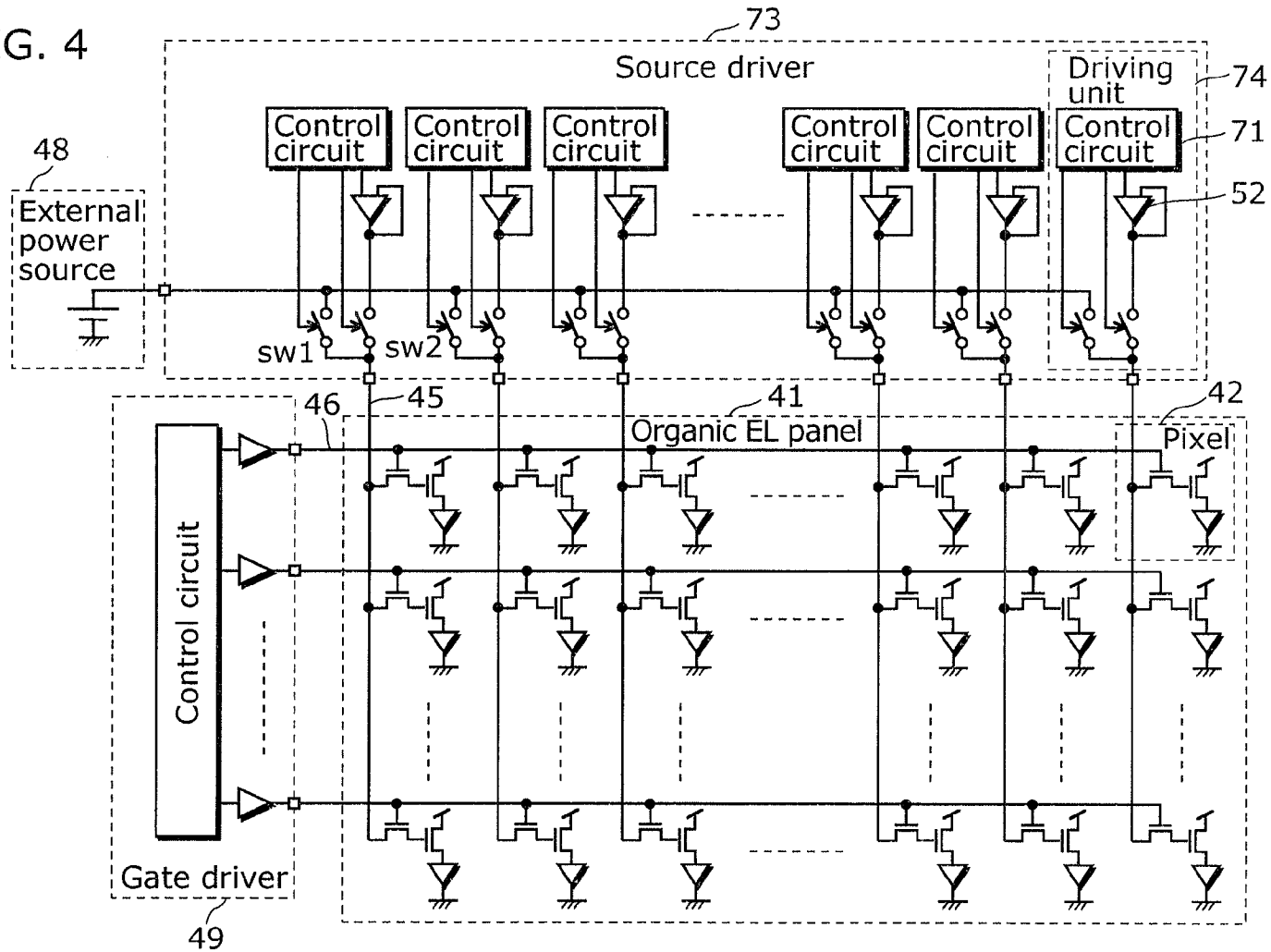
FIG. 4 is an overall structural diagram illustrating a display apparatus according to the second embodiment.

FIG. 4 is an overall structural diagram illustrating a display apparatus according to the second embodiment. The display apparatus in this figure is different from the display apparatus shown in FIG. 1 in that a source driver 73 is provided instead of the source driver 43. The same components are assigned the same numerals and different features thereof will mainly be described while description of the common features will be omitted.

The source driver 73 is different from the source driver 43 shown in FIG. 1 in that the control circuit 47 no longer exists and in that a driving unit 74 is provided instead of the driving unit 44.

The driving unit 74 includes a control circuit 71, an AMP unit 52, a first switch sw1, and a second switch sw2.

The control circuit 71 has the function of the control circuit 51 shown in FIG. 1 and additionally compares a current pixel signal and the subsequent pixel signal with each other to thereby determine whether the current pixel signal and the subsequent pixel signal are across the above intermediate voltage, and according to this determination, the control circuit 71 further determines whether to temporarily turn on and off the first and the second switches or to maintain current states of the first and the second switches during the above transition period.

Specifically, when the current image pixel signal and the subsequent pixel signal are across the above intermediate voltage, the control circuit 71 causes corresponding ones of the first and the second switches to be turned on and off temporarily during the above transition period, and when the current image pixel signal and the subsequent pixel signal are not across the above intermediate voltage, the control circuit 71 maintains the current states of the corresponding ones of the first and the second switches during the above transition period.

Figure 5:
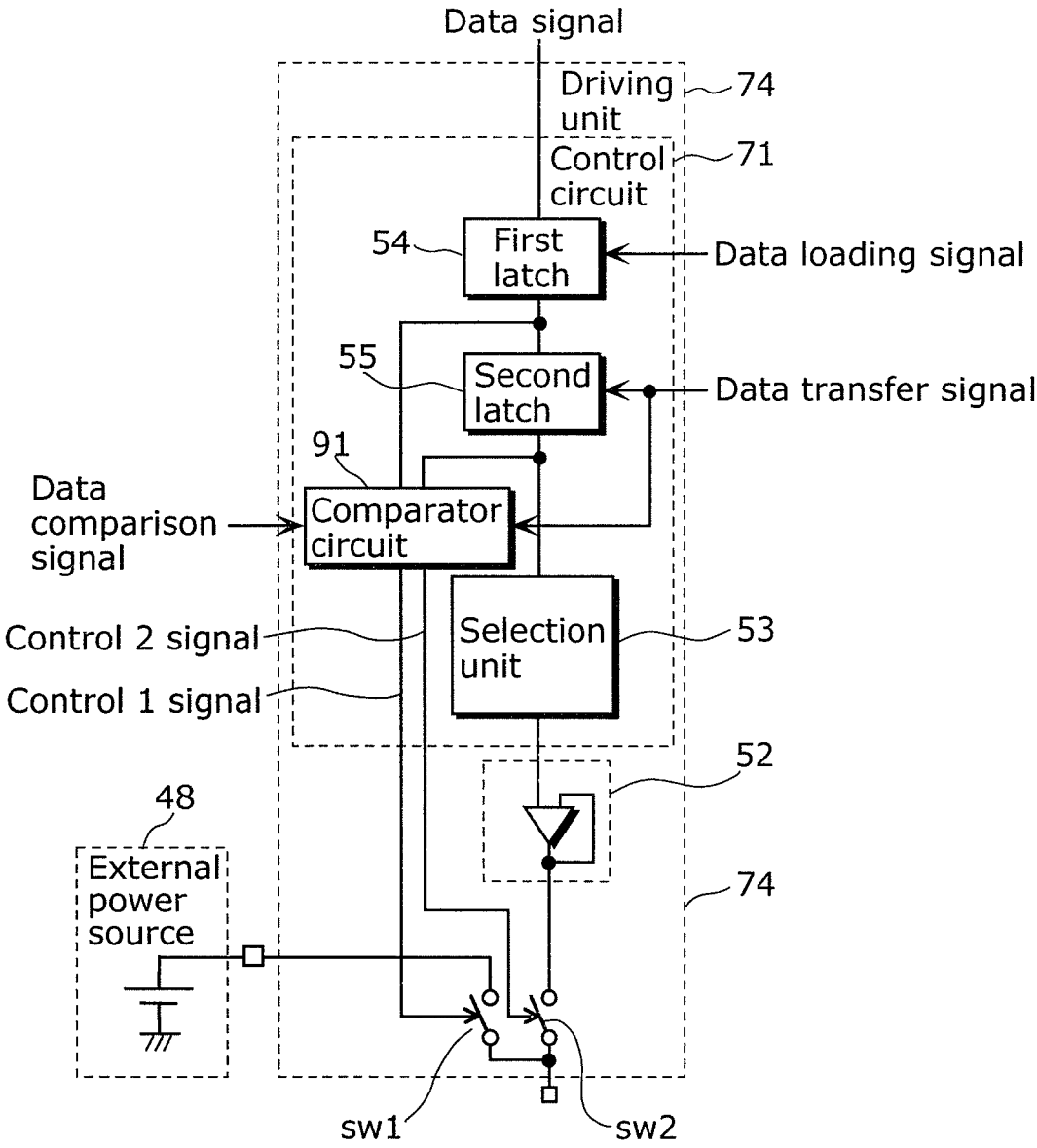
FIG. 5 is a view illustrating an example of detailed structure of a driving unit in a display driving device according to the second embodiment.

FIG. 5 is a view illustrating an example of detailed structure of the driving unit 74 in a display driving device according to the second embodiment. The driving unit 74 in this figure is different from the driving unit 44 shown in FIG. 1 in that a comparator circuit 91 is added.

The comparator circuit 91 compares the current pixel signal (pixel data from the second latch 55) and the subsequent pixel signal (pixel data from the first latch 54) and then generates the control 1 signal and the control 2 signal according to a result of the above comparison.

Figure 6:
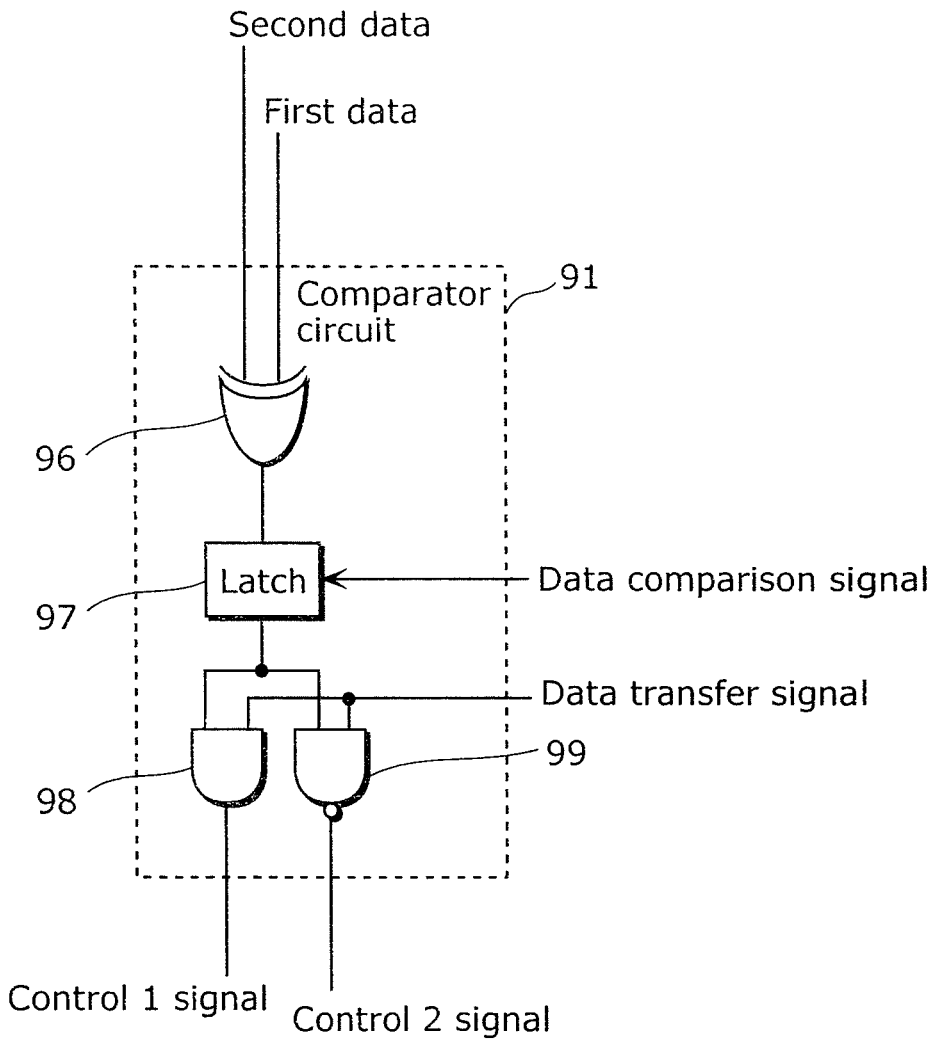
FIG. 6 is a view illustrating an example of detailed structure of a comparator circuit according to the second embodiment.

FIG. 6 is a view illustrating an example of detailed structure of the comparator circuit 91 according to the second embodiment. The comparator circuit 91 in this figure includes a comparator 96, a latch 97, AND gates 98, and a NAND gate 99.

The comparator 96 determines whether or not the current pixel signal (pixel data from the second latch 55) and the subsequent pixel signal (pixel data from the first latch 54) are across the above intermediate voltage (a median of the pixel data). The comparator 96 shown in this figure may be an exclusive OR circuit which determines whether or not the most significant bit (abbreviated as MSB) of the pixel data from the second latch 55 coincides with the most significant bit (abbreviated as MSB) of the pixel data from the first latch 54. In this case, with these MSBs not coincident with each other, the comparator 96 outputs "1" which indicates that these data are across the median of the pixel data, and with these MSBs coincident with each other, the comparator 96 outputs "0" which indicates that these data are not across the median of the pixel data. What are compared by the comparator 96 are digital pixel data which have not yet been converted into analog pixel data. It is therefore possible to simplify the circuit.

Upon receiving a data comparison signal, the latch 97 loads and retains a one-bit flag that indicates a result of comparison in the comparator 96; that is, whether or not the above MSBs coincides with each other.

With a flag "1" in the latch 97 (when the above data are across the above median), the AND gate 98 outputs the control 1 signal in synchronization with a data transfer signal, and with a flag "0" in the latch 97 (when the above data are not across the above median), the AND gate 98 outputs the control 1 signal independently from the data transfer signal. With a flag "1" in the latch 97 (when the above data are across the above median), the AND gate 98 outputs the control 1 signal which causes the first switch sw1 to be turned on temporarily, and concurrently, outputs the control 2 signal which causes the corresponding second switch sw2 to be turned off temporarily, in synchronization with the data transfer signal (that is, during the transition period).

With a flag "0" in the latch 97 (when the above data are not across the above median), the AND gate 98 and the NAND gate 99 do not change the control 1 signal and the control 2 signal during the transition period. In this case, the first switch sw1 and the second switch sw2 remain still.

Figure 7:
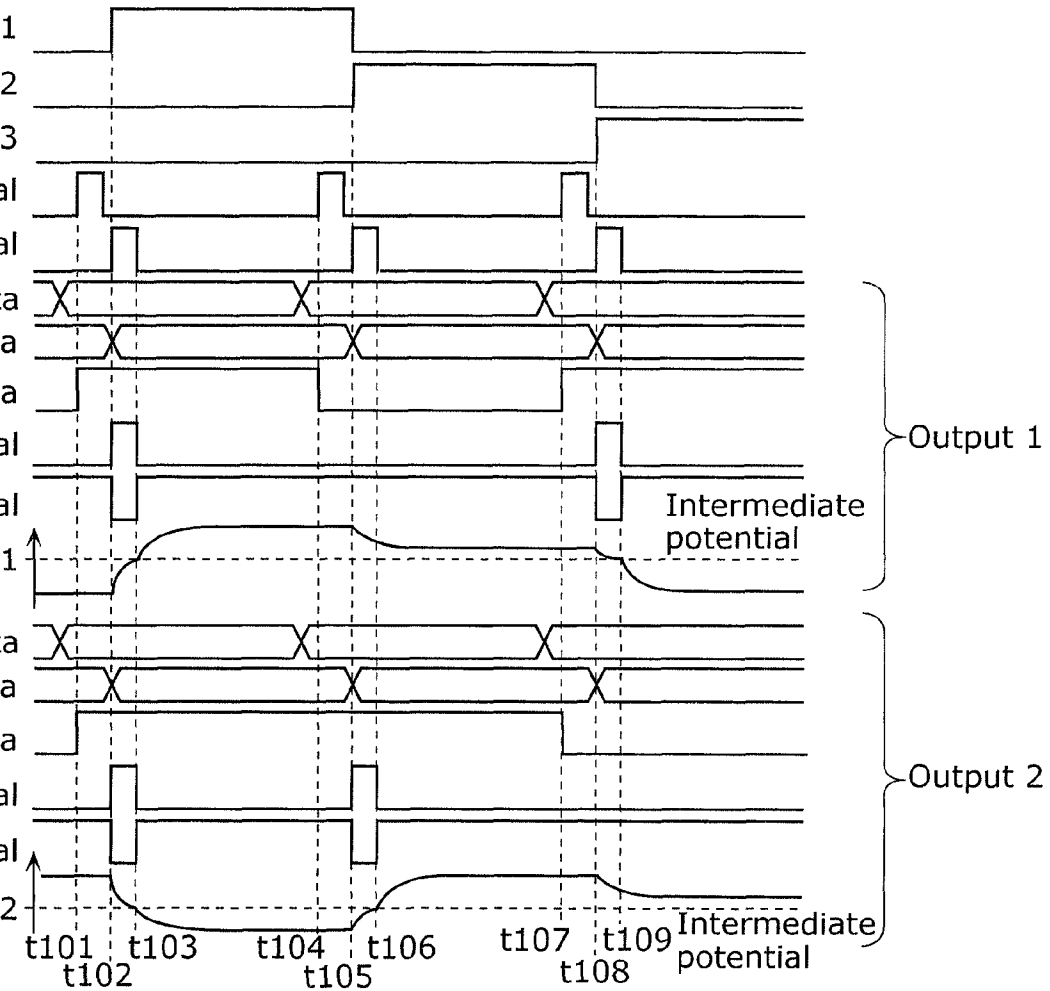
FIG. 7 is a timing chart for operations of the display apparatus according to the second embodiment.

The following shall describe operations of the display apparatus and the display driving device in the second embodiment of the present invention, with reference to FIG. 7.

In FIG. 7, a rise of the gate signal 1 is called t102, a rise of the gate signal 2 is called t105, a rise of the gate signal 3 is called t108, falls of the data transfer signal are called t103, t106, t109, and rises of the data comparison signal are called t101, t104, and t107.

During the period with the data comparison signal "low" in FIG. 7, the comparator 96 compares more significant data from the first latch 54 with the more significant data from the second latch 55.

Subsequently, the most significant bit of the output data from the first latch 54 is inputted as the first data to the comparator 96, and the most signification bit of the output data from the second latch 55 is inputted as the second data to the comparator 96. With both of the first and the second data "high" or "low", the comparator 96 outputs "low". This "low" output means that the first data and the second data are not across the above median. With the first data "high" and the second data "low", or with the first data "low" and the second data "low", the comparator 96 outputs "high". This "high" output means that the first data and the second data are across the above median.

Next, the comparison data outputted from the comparator 96 is received by the latch 97 in synchronization with the rise t101 of the data comparison signal.

Subsequently, in synchronization with the rise t102 of the data transfer signal, the data is transferred to the second latch 55. If the comparison data in the latch 97 is "high", pulses of the control 1 signal and the control 2 signal are outputted during the period with the data transfer signal "high". If the comparison data is "low", no change occurs in the control 1 signal and the control 2 signal during the period with the data transfer signal "high".

As described so far, the display apparatus and the display driving device according to the second embodiment of the present invention allows for one application of the intermediate potential from the external power source in accordance with the image data, even in an organic EL panel in which a positive video signal and a negative video signal are not alternately driven.

In addition, in the display apparatus and the display driving device according to the present invention, the most significant bit of the image data changes from "low" to "high", for example, when 1 V is applied to one line and 11 V is applied to the following line. In this case, the first data 92 is "low" while the second data 93 is "high", and the comparator 96 outputs "high".

In other words, the comparator 96 compares the two different data to determine whether or not they are across the intermediate potential 6V, and when they are across the intermediate potential 6V, the lines are controlled to be connected to the external power source so that the intermediate potential can be applied once to the lines.

On the other hand, when they are not across the intermediate potential 6V, that is, when both of the first data 92 and the second data 93 are "high" or "low", the lines are controlled so that they are not connected to the external power source, with the result that wasteful movement of charges can be reduced to save more electrical power than in the first embodiment.

Further, in the present embodiment, as in the case of the first embodiment, electricity which conventionally used to be driven by the source driver 73 is generated by the external power source 48 instead, whereby the amount of heat produced by the source driver 73 can be reduced, so that the source driver 73 can output more, which makes it possible to save the cost of the organic EL panel by reducing the chips.

Third Embodiment

The first and the second embodiments involve one type of the intermediate voltage which is supplied from the external power source 48. In contrast, the third embodiment involves the structure, which will be described below, that when voltage ranges of the pixel signal to be driven to the source lines are different for each color, most suitable intermediate voltage for each color is supplied.

Figure 8:
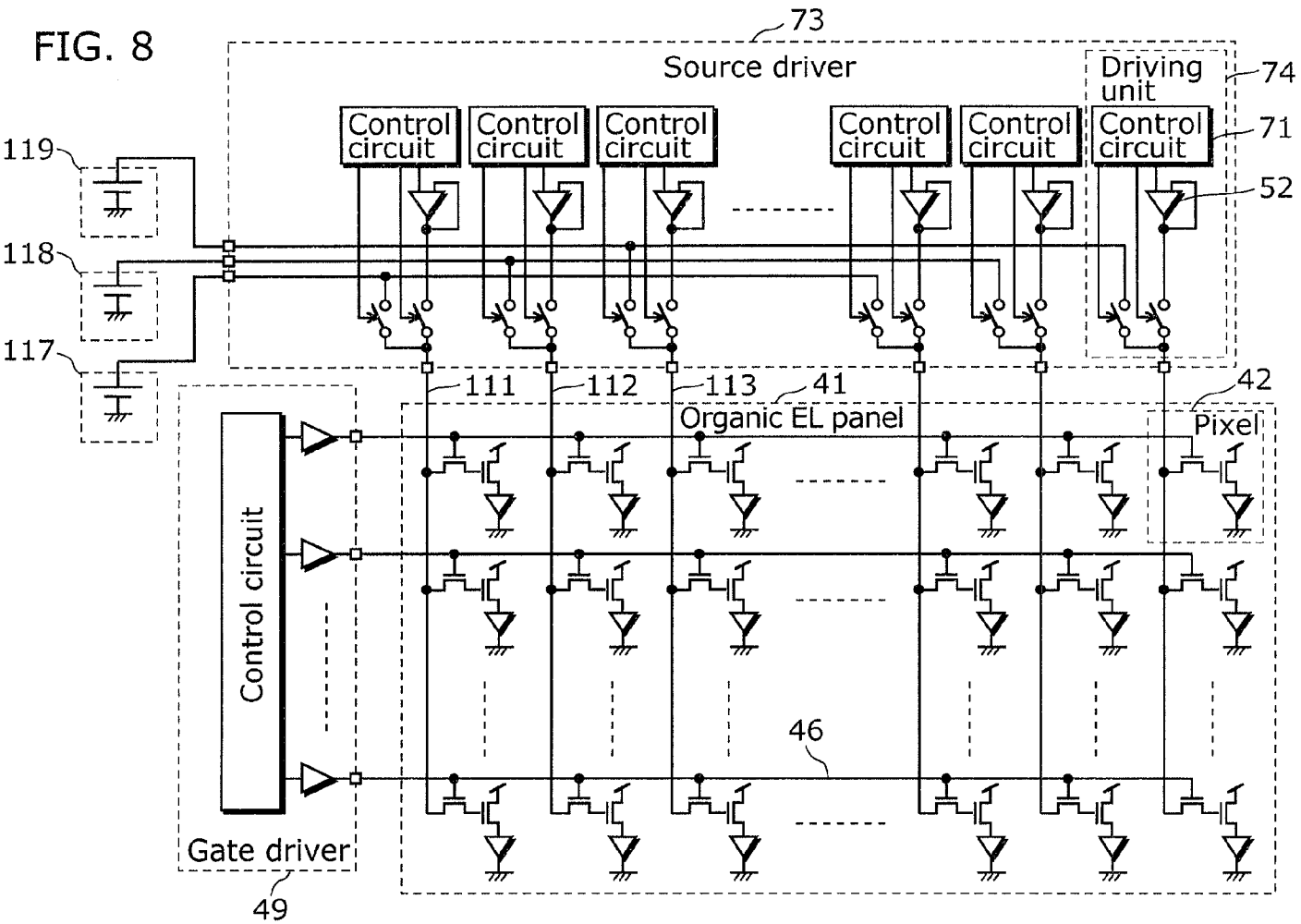
FIG. 8 is an overall structural diagram illustrating a display apparatus according to the third embodiment.

FIG. 8 illustrates an example of structures of a display apparatus and a display driving device according to the third embodiment. The display apparatus in FIG. 8 is different from the display apparatus shown in FIG. 4 in that a first external power source 117, a second external power source 118, and a third external power source 119 are provided instead of the external power source 48. The same components are assigned the same numerals and different features thereof will mainly be described while description of the common features will be omitted.

The first external power source 117, which outputs a first voltage, is connected via a first switch sw1 to a first source line 111 corresponding to an R (red) pixel column among the multiple source lines 45. The first voltage is the median between the maximum and the minimum values of the pixel signal representing R (red), for example.

The second external power source 118, which outputs a second voltage, is connected via a first switch sw1 to a second source line 112 corresponding to a G (green) pixel column among the multiple source lines 45. The second voltage is the median between the maximum and the minimum values of the pixel signal representing G (green), for example.

The third external power source 119, which outputs a third voltage, is connected via a first switch sw1 to a third source line 113 corresponding to a B (blue) pixel column among the multiple source lines 45. The third voltage is the median between the maximum and the minimum values of the pixel signal representing B (blue), for example.

The display apparatus and the display driving device in the third embodiment, which are configured as above, operate in the same manner as those in the second embodiment except for the intermediate voltage. The intermediate voltage in the third embodiment may be set as the first, second, and third voltages which correspond to R, G, and B, respectively, when the voltage ranges of the pixel signal are different for each color. This makes it possible to efficiently save electrical power and reduce heat generation, individually for each of the R source line, the G source line, and the B source line.

By providing different external power sources for R, G, and B as described above, it is possible to set the most suitable intermediate potential for each of R, G, and B, which can lead to economical power saving, for example, in the case where the voltages outputted to the R, G, and B source lines are different from each other, which means that the intermediate potential thereof are all different.

It is to be noted that the external power source 48 in the first embodiment may be replaced by the first external power source 117, the second external power source 118, and the third external power source 119.

If the pixel signals of two colors out of R, G, and B have the same voltage range, it is preferable to provide not three but two external power sources.

The multiple pixels 42 may represent the first to n-th colors other than the R, G, and B colors. This means that the colors are not fixed to the three colors of R, G, and B, but may be four, five, or more colors to broaden the range of color reproducibility.

Further, in the present embodiment, as in the case of the first embodiment, electricity which conventionally used to be driven by the source driver 73 is generated by the external power sources 117, 118, and 119 instead, whereby the amount of heat produced by the source driver 73 can be reduced, allowing for a further increase in the pixel signal output per chip of the source driver 73, which makes it possible to save the cost of the organic EL panel by reducing the chips.

Fourth Embodiment

The above description of the first embodiment shows the structure that during the transition period, the external power source 48 is kept connected to one end of each of the first switches sw1, and the following (A) to (C) occurs simultaneously; (A) the source lines 45 are electrically shorted to one another with the first switches sw1 on, (B) the source lines 45 are disconnected from the driving units 44 with the second switches sw2 off, and (C) the intermediate voltage is applied to the source lines 45. In contrast, the fourth embodiment involves the structure, which will be described below, that the above (C) occurs later than (A) and (B). The reason for delaying (C) is for prevention of noise and shoot-through current.

Figure 9:
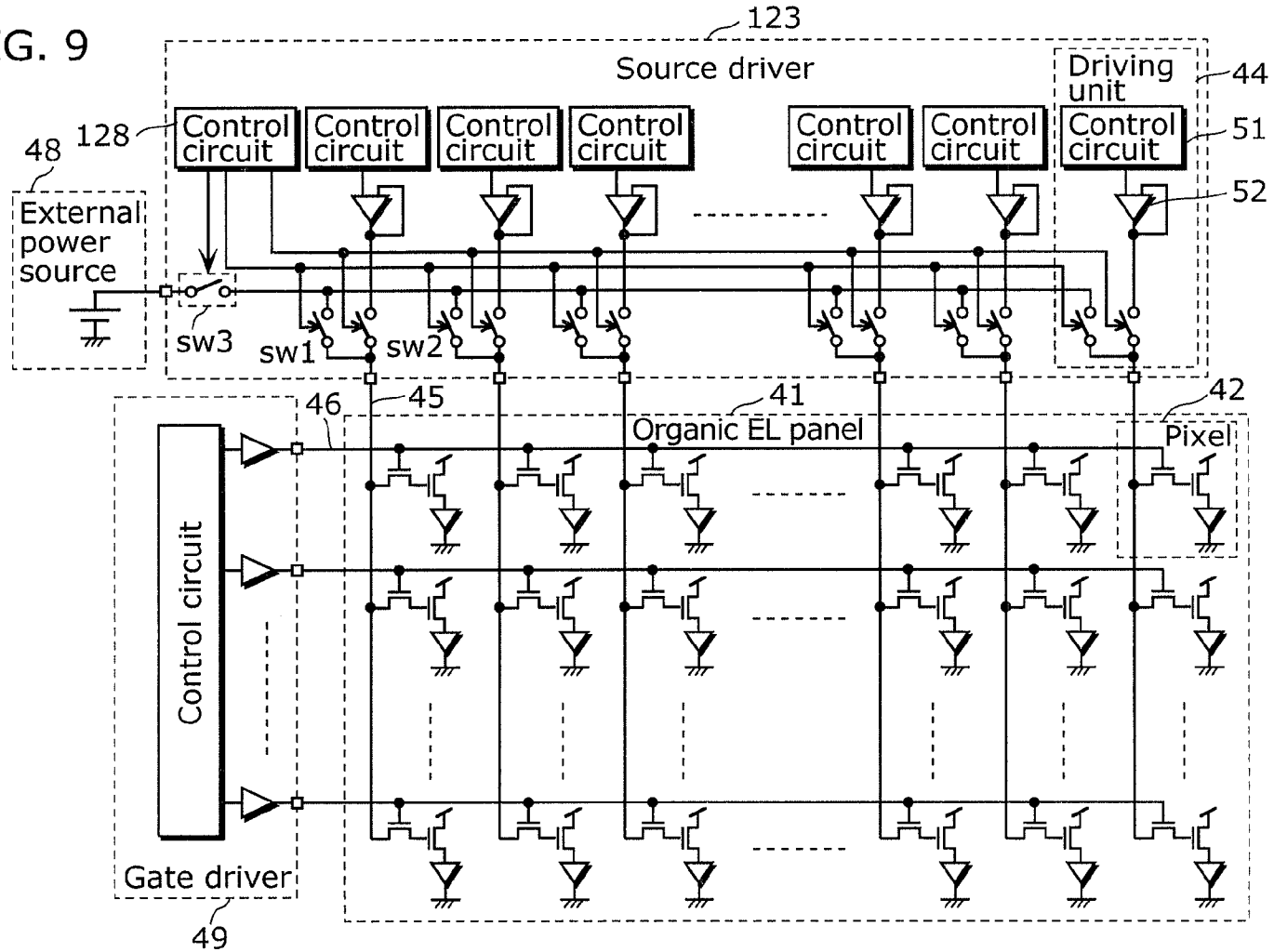
FIG. 9 is an overall structural diagram illustrating a display apparatus according to the fourth embodiment.

FIG. 9 illustrates an example of structures of a display apparatus and a display driving device according to the fourth embodiment. The display apparatus in FIG. 9 is different from the display apparatus shown in FIG. 1 in that a source driver 123 is provided instead of the source driver 43. The same components are assigned the same numerals and different features thereof will mainly be described while description of the common features will be omitted.

The source driver 123 is different from the source driver 43 in that a third switch sw3 is added and in that a control circuit 128 is provided instead of the control circuit 47.

The third switch sw3 is inserted into an intermediate voltage line which connects the external power source 48 with the first switches sw1. The third switch sw3 is turned on when supplied with "high" signals from the control circuit 128.

The control circuit 128 has the function of the control circuit 47 and additionally controls the timing to turn on the third switch sw3, thereby causing the above (C) to occur after the above (A) and (B) (that is, delaying the timing for a supply signal).

Figure 10:
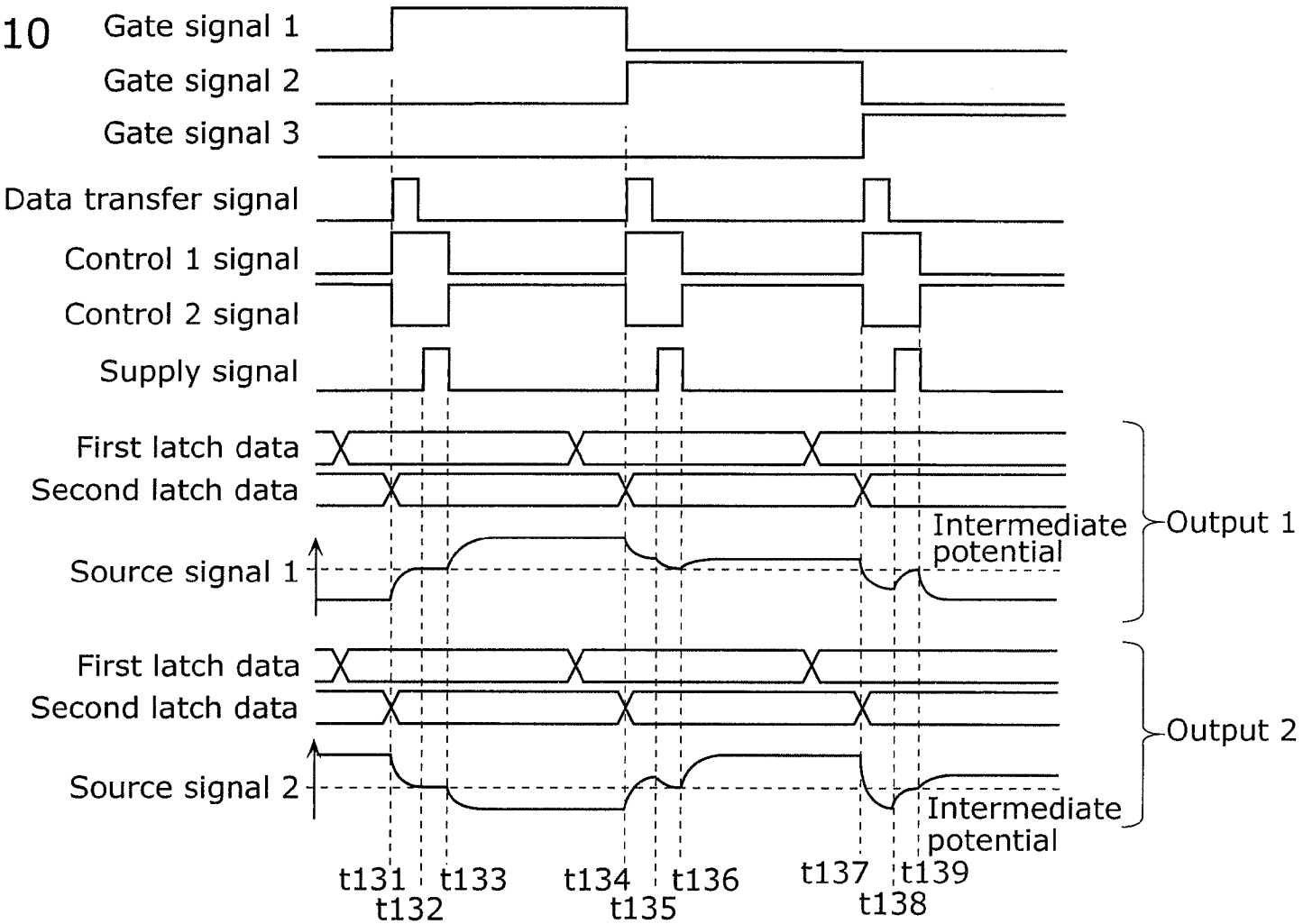
FIG. 10 is a timing chart for operations of the display apparatus according to the fourth embodiment.
Figure 11:
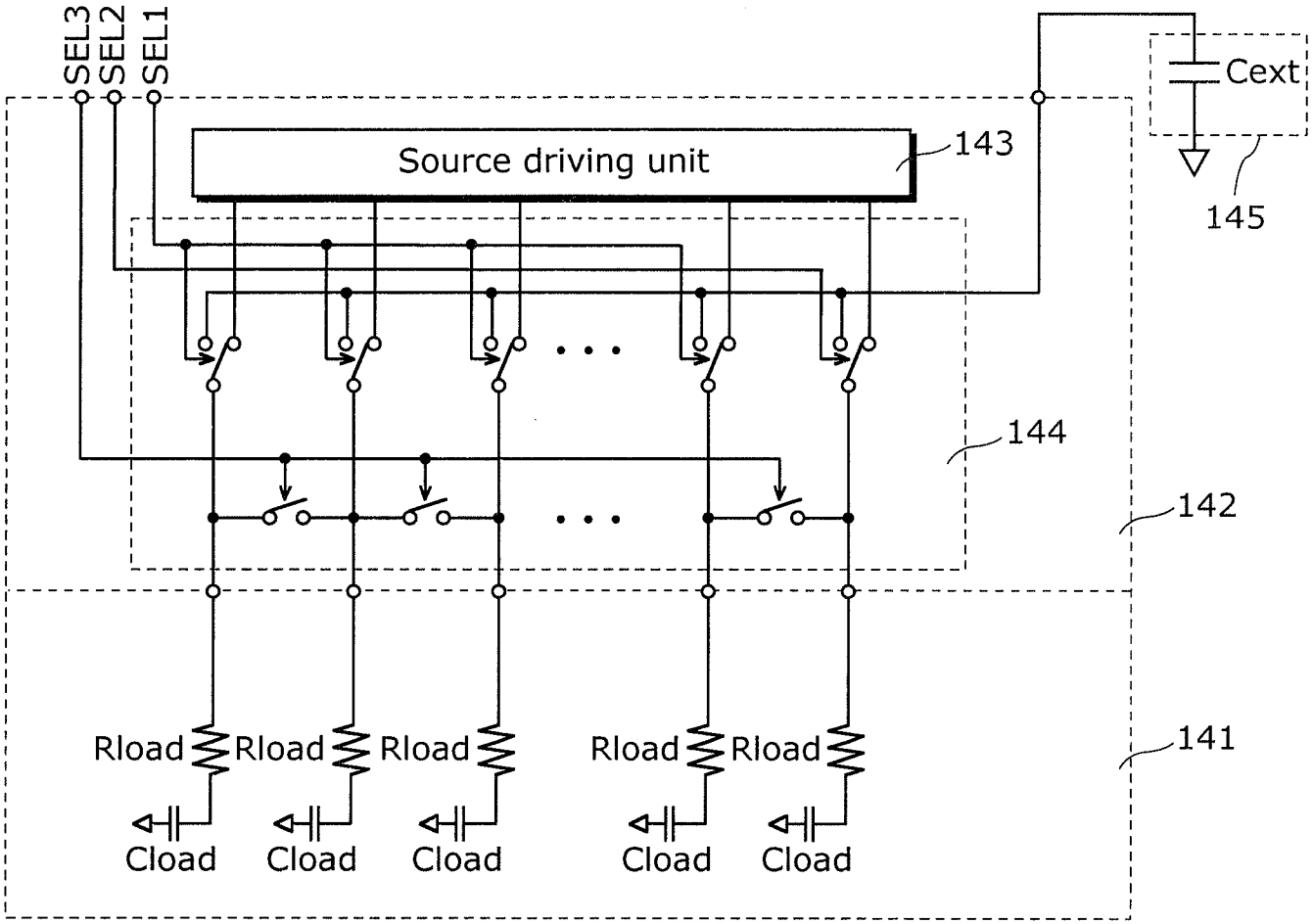
FIG. 11 is a view illustrating an overall structure of a conventional display apparatus using the inversion driving scheme.
Figure 12:
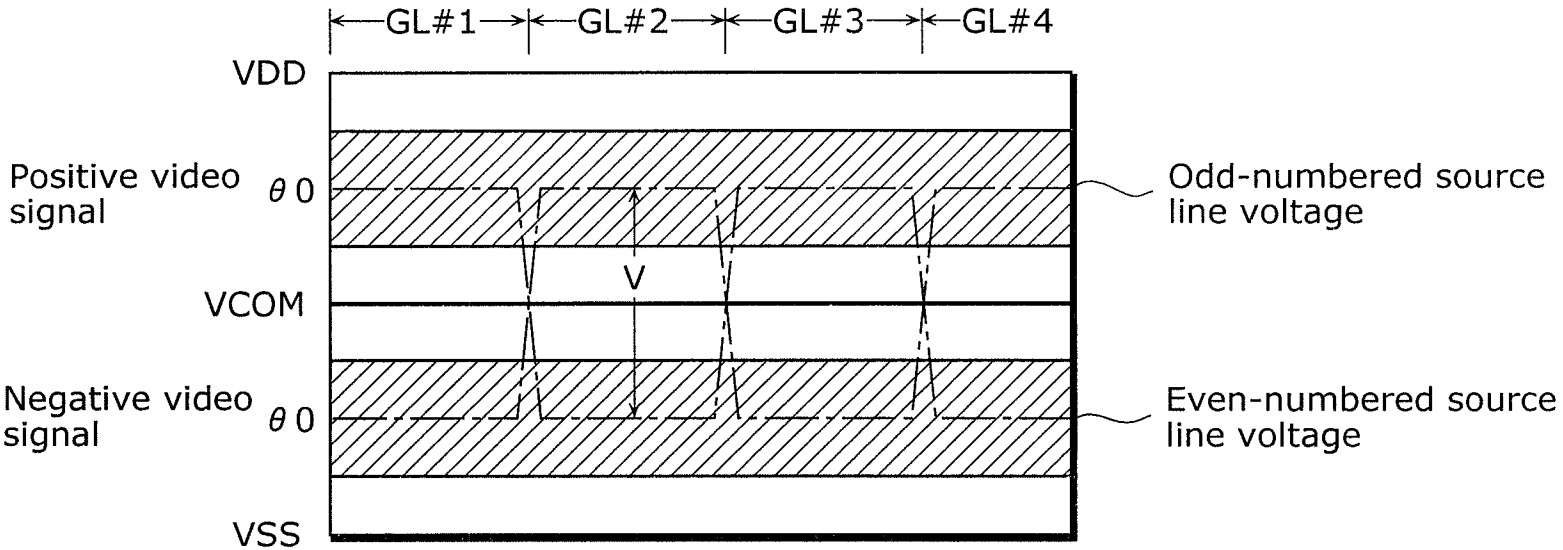
FIG. 12 is a view illustrating a positive video signal and a negative video signal in the conventional inversion driving scheme.

The following shall describe operations of the display apparatus and the display driving device in the fourth embodiment, with reference to FIG. 10. The operations of the display apparatus and the display driving device in the fourth embodiment are the same as those in the first embodiment except that the above (C) is caused to occur after the above (A) and (B) (that is, the timing for the supply signal is delayed), and the following description therefore focuses on differences of the display apparatus and the display driving device in the fourth embodiment from those in the first embodiment.

With the supply signal "high", the third switch sw3 is turned on and with the supply signal "low", the third switch sw3 is turned off. At the time t131 in this figure, the control 1 signal becomes "high" and the control 2 signal becomes "low" in synchronization with the data transfer signal, resulting in the first switch sw1 connected and the second switch sw2 disconnected (which correspond to the above (A) and (B), respectively).

In this case, the supply signal remains "low" and the source lines 45 are electrically shorted to one another but not supplied with the intermediate voltage.

Subsequently, the supply signal changes to "high" and the source lines 45 become connected to the external power source 48 so that the intermediate voltage supplied from the external power source 48 is applied to the source lines 45 as shown in FIG. 10 (which corresponds to the above (C)).

Afterwards, the control 1 signal becomes "low", the control 2 signal "high", and the supply signal "low", resulting in the first switch sw1 disconnected, the second switch sw2 connected, and the third switch sw3 disconnected. This causes each of the source line 45 to be connected to a corresponding one of the AMP units 52 so that voltage corresponding to the image data is applied to each of the source lines 45. The above operation is repeated for all the lines so that the voltage corresponding to the image data is applied to the pixels 42 which receive "high" gate signals. Such voltage application is repeated in sequence for all the lines to display one frame.

As described above, the present embodiment has the same effects as those given by the first embodiment, and additionally is capable of preventing noise and shoot-through current by delaying the timing of the intermediate voltage application to the source lines 45.

It is to be noted that the external power source for the intermediate potential provided in the present embodiment may be replaced by such multiple external power sources for different values of potential as those in the third embodiment so that each of the lines is connected to one of the external power sources which has the closest potential to the image data to be displayed, since this allows for further electrical power saving.

SUMMARY

As described above with reference to the drawings, the display driving device and the display apparatus according to the first to the fourth embodiments of the present invention enables even a display apparatus which does not perform inversion driving, such as an organic EL panel, to reuse charges as well as to reduce heat generation with a power source outside the apparatus, which allows for higher output and leads to cost saving.

Further, it is possible to reuse charges in each of the driving units only when necessary.

Furthermore, the comparison of the data makes it possible to, for example, efficiently reuse charges within the closed space of the IC, thereby allowing for reduction in wasteful power consumption.

Moreover, in the case where the voltage output ranges of the driving units are different for each of R, G, and B, different external power sources are provided for R, G, and B, and by doing so, it is possible to supply intermediate potential which is individualized for each of R, G, and B, allowing for improved efficiency of reuse of charges as well as reduction in power consumption.

In addition, by connecting the source lines to one another before supplying power thereto from the external power source, it is possible to reduce the effects of noise and shoot-through current as compared to those in the case where such connection and power supply are performed at the same time.

Comparative Example

The following shall describe, with reference to the drawings, structures and operations of a display apparatus which does not perform inversion driving and to which the present invention is not applied, and a display driving device which drives such a display apparatus, as a comparative example of the display apparatus and the display driving device according to each of the embodiments of the present invention.

Figure 13:
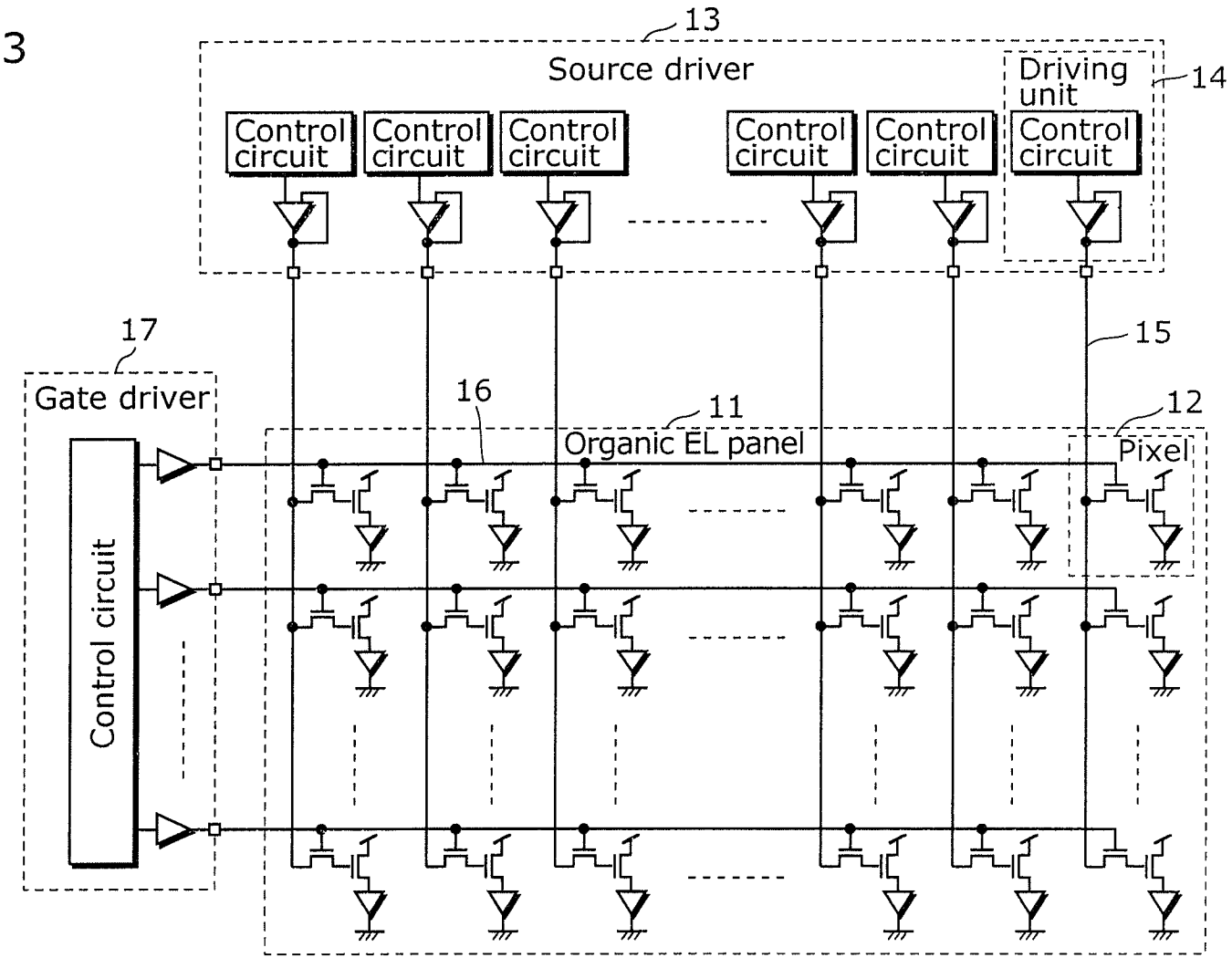
FIG. 13 is a view illustrating an overall structure of a display apparatus which does not perform inversion driving, given as a comparative example.
Figure 14:
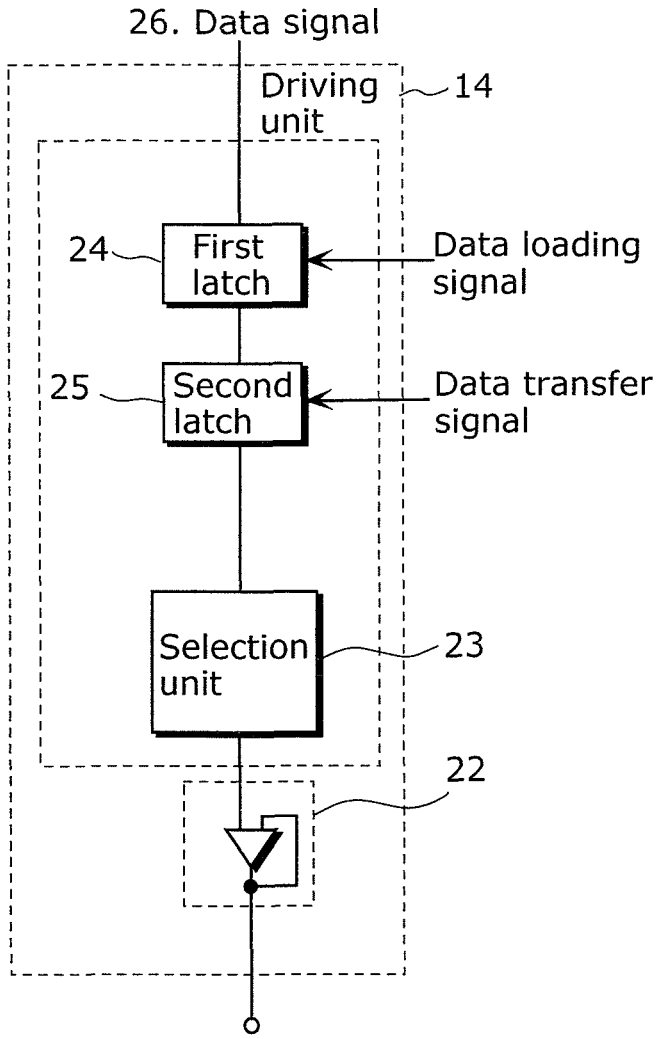
FIG. 14 is a view illustrating a structure of a driving unit in the comparative example, which does not perform inversion driving.

FIG. 13 is a view illustrating a structure of the display apparatus having an organic EL panel according to the comparative example. FIG. 14 is a view illustrating a structure of a driving unit according to the comparative example.

Referring to FIG. 13, the display apparatus includes an organic EL panel 11, a source driver 13, and a gate driver 17. The organic EL panel 11 has a plurality of pixels 12, source lines 15 each provided for a corresponding one of columns of the pixels, and gate lines 16 each provided for a corresponding one of rows of the pixels. The source driver 13 includes driving units 14 each provided for a corresponding one of the source lines 15.

Referring to FIG. 14, each of the driving units 14 includes an AMP unit 22, a selection unit 23, a first latch 24, and a second latch 25.

Figure 15:
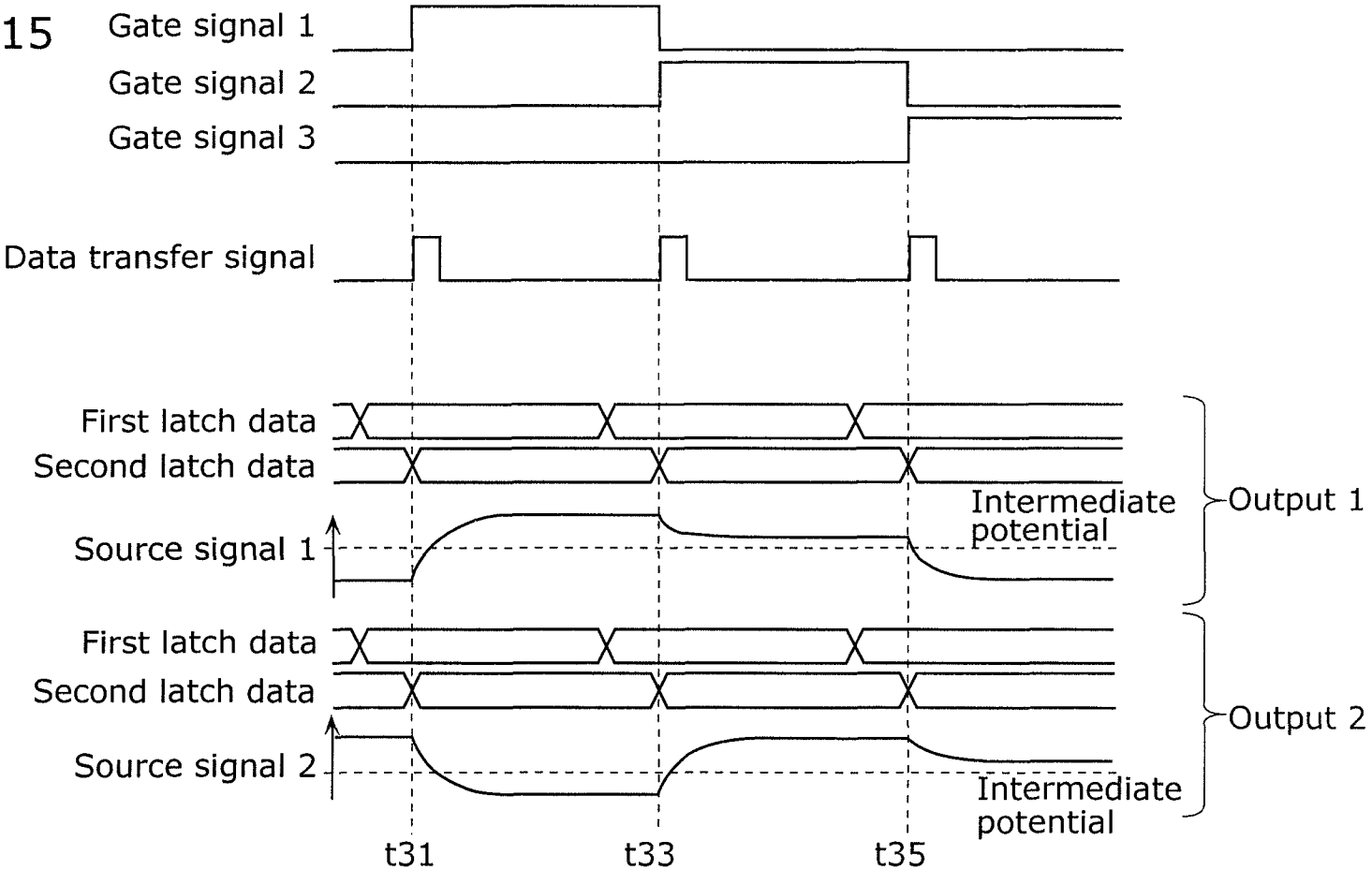
FIG. 15 is a timing chart in the comparative example, for the display apparatus which does not perform inversion driving.

FIG. 15 is a timing chart for operations of the display apparatus shown in FIG. 13 and FIG. 14.

Signal level status of three lines out of the multiple gate lines 16 in the organic EL panel 11 are shown as a gate signal 1, a gate signal 2, and a gate signal 3. Further, signal level status of two lines out of the multiple source lines 15 in the EL panel 11 are shown as a source signal 1 and a source signal 2. Furthermore, a dashed line indicates intermediate potential of output range of each of the source signals. Moreover, a rise of the gate signal 1 is called t31, a rise of the gate signal 2 is called t32, and a rise of the gate signal 3 is called t33.

The following shall describe operations of the display apparatus configured as above.

The first latch 24 retrieves image data of a digital signal when triggered by a data loading signal. All the driving units 14 in an IC constituting the source driver 13 then perform the above operation in sequence. After the first latches 24 in all the driving units 14 retrieve desired image data, the data is transferred to the second latches 25 in synchronization with the rise t31 of the data transfer signals shown in FIG. 15. The image data transferred to the second latch 25 is inputted to the selection unit 23, and a desired analog voltage is transferred to the AMP unit 22 which then outputs the voltage to a corresponding one of the source lines 15. The above operation is repeated for all the lines so that the voltage corresponding to the image data is applied to the pixels 12 which receive "high" gate signals. Such voltage application is repeated in sequence for all the lines to display one frame.

As just described, variations of charges in the source lines will be absorbed by the AMP unit 22 serving as a driver. This means that in every transition period, electric currents corresponding to such variations of charges will flow through the AMP unit 22 which thus generates heat and consumes power undesirably. The display apparatus in the comparative example described herein with reference to FIGS. 13 to 15 has difficulty in saving power and moreover it has a problem of heat generation. In contrast, the display apparatus and the display driving device according to each of the embodiments of the present invention are capable of reducing heat generation and saving power.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The display apparatus according to the present invention is useful for a display such as an organic EL panel. In addition, the present invention may be applied to, for example, a printer driver which uses voltage in driving.

What is claimed is:

1. A display driving device that drives a display panel having source lines each provided for a corresponding one of columns of pixels, said display driving device comprising:

first switches each provided for a corresponding one of the source lines;

second switches each provided for a corresponding one of the source lines;

drivers each of which is provided for a corresponding one of the source lines and drives a pixel signal to the corresponding one of the source lines via a corresponding one of said second switches;

a power source unit configured to apply an intermediate voltage of the pixel signal to an intermediate voltage line, the intermediate voltage having a level between a minimum voltage level and a maximum voltage level of the pixel signal; and a control unit configured to control turning on and off said first switches and said second switches, and a third switch inserted between the intermediate voltage line and said first switches by a series connection, wherein each of said first switches has a first end connected to the intermediate voltage line and a second end connected to a corresponding one of the source lines, each of said second switches has a first end connected to a corresponding one of said drivers and a second end connected to a corresponding one of the source lines and to a second end of a corresponding one of said first switches, and said control unit is configured to temporarily turn off at least part of said second switches, and concurrently, temporarily turn on corresponding ones of said first switches, and after turning on said corresponding first switches, temporarily turn on said third switch during a transition period from an output period of a pixel signal to an output period of a subsequent pixel signal.

2. The display driving device according to claim 1, wherein said drivers, said first switches, said second switches, and said control unit are formed on a first semiconductor substrate, and said power source unit is formed on a second semiconductor substrate.

3. A display apparatus comprising:

the display driving device according to claim 2; and a display panel driven by said display driving device.

4. The display driving device according to claim 1, wherein said control unit is configured to temporarily turn off all said second switches, and concurrently, temporarily turn on all said first switches during the transition period.

5. A display apparatus comprising:

the display driving device according to claim 4; and a display panel driven by said display driving device.

6. The display driving device according to claim 1, wherein said control unit has control circuits each provided for a corresponding one of the source lines, each of said control circuits temporarily turns on and off corresponding ones of said first switches and said second switches during the transition period in the case where a pixel signal and a subsequent pixel signal in a corresponding one of the source lines are across the intermediate voltage, and each of said control circuits maintains current states of corresponding ones of said first switches and said second switches during the transition period in the case where the a pixel signal and the subsequent pixel signal in the corresponding one of the source lines are not across the intermediate voltage.

7. A display apparatus comprising:

the display driving device according to claim 6; and a display panel driven by said display driving device.

8. The display driving device according to claim 1, wherein the intermediate voltage line includes a first voltage line connected to one of the source lines for a first color via a corresponding one of said first switches, and a second voltage line connected to one of the source lines for a second color via a corresponding one of said second switches, and said power source unit is configured to output, as the intermediate voltage, a first voltage having a level intermediate between a minimum voltage level and a maximum voltage level of a pixel signal representing the first color, and is configured to output, as the intermediate voltage, a second voltage having a level intermediate between a minimum voltage level and a maximum voltage level of a pixel signal representing the second color.

9. A display apparatus comprising:

the display driving device according to claim 8; and a display panel driven by said display driving device.

10. A display apparatus comprising:

the display driving device according to claim 1; and a display panel driven by said display driving device.

11. The display apparatus according to claim 10, wherein said display panel is an organic electroluminescent (EL) panel.

* * * * *